US011234066B2

(12) United States Patent
Ko et al.

(10) Patent No.: US 11,234,066 B2
(45) Date of Patent: Jan. 25, 2022

(54) EARPHONE

(71) Applicant: ALMUS Corp., Chungcheongnam-do (KR)

(72) Inventors: Ju Heon Ko, Hwaseong-si (KR); Byung Il Min, Suwon-si (KR); Yun Uk Ha, Incheon (KR); Jeong Kwon Park, Yeoju-si (KR); Yeong Jae Lee, Yongin-si (KR)

(73) Assignee: ALMUS CORP., Chungcheongnam-Do (KR)

( * ) Notice: Subject to any disclaimer, the term of this patent is extended or adjusted under 35 U.S.C. 154(b) by 0 days.

(21) Appl. No.: 16/893,646

(22) Filed: Jun. 5, 2020

(65) Prior Publication Data

US 2021/0289280 A1 Sep. 16, 2021

(30) Foreign Application Priority Data

Mar. 16, 2020 (KR) ..... 10-2020-0031891

(51) Int. Cl.
*H04R 5/04* (2006.01)
*H04R 1/10* (2006.01)

(52) U.S. Cl.
CPC ..... *H04R 1/1016* (2013.01)

(58) Field of Classification Search
CPC ..... H04R 1/06; H04R 1/1075; H04R 25/604; H04R 2400/11
See application file for complete search history.

(56) References Cited

U.S. PATENT DOCUMENTS

| | | | | |
|---|---|---|---|---|
| 9,055,369 | B2 * | 6/2015 | Yang | H04R 1/26 |
| 9,258,649 | B2 * | 2/2016 | Tanaka | H04R 9/06 |
| 9,319,767 | B2 * | 4/2016 | Sakaguchi | H04R 25/02 |
| 9,838,799 | B2 * | 12/2017 | Doshida | H04R 17/00 |
| 10,805,709 | B1 * | 10/2020 | Keady | H04R 1/1016 |
| 10,893,355 | B2 * | 1/2021 | Huang | H01R 12/714 |
| 10,924,839 | B2 * | 2/2021 | Jou | H04R 1/04 |
| 10,986,440 | B2 * | 4/2021 | Hu | H04R 1/1016 |
| 11,026,012 | B1 * | 6/2021 | Ko | H04R 1/2826 |
| 2005/0220319 | A1 * | 10/2005 | Chan | H04R 1/1033 381/374 |
| 2015/0110329 | A1 * | 4/2015 | Tanaka | H04R 1/1016 381/380 |
| 2017/0099536 | A1 * | 4/2017 | Schoeffmann | H04R 1/06 |
| 2021/0021920 | A1 * | 1/2021 | Choi | H04R 1/2826 |
| 2021/0037307 | A1 * | 2/2021 | Huang | H04R 1/1058 |

* cited by examiner

*Primary Examiner* — Ryan Robinson
(74) *Attorney, Agent, or Firm* — Li & Cai Intellectual Property (USA) Office

(57) ABSTRACT

Disclosed is an earphone including a housing, a speaker unit accommodated in the housing, and a printed circuit board (PCB) accommodated in the housing, disposed below the speaker unit, and configured to provide an electrical signal to the speaker unit. Here, the speaker unit includes a first diaphragm, a first voice coil fixed to the first diaphragm, at least one magnet disposed below the first diaphragm, a frame which accommodates the first diaphragm, the first voice coil, and the magnet, and a substrate which receives and transmits an electrical signal from the PCB to the first voice coil. The substrate is disposed on an upper side of the speaker unit. The earphone further includes a connection pin.

10 Claims, 9 Drawing Sheets

【FIG.1】
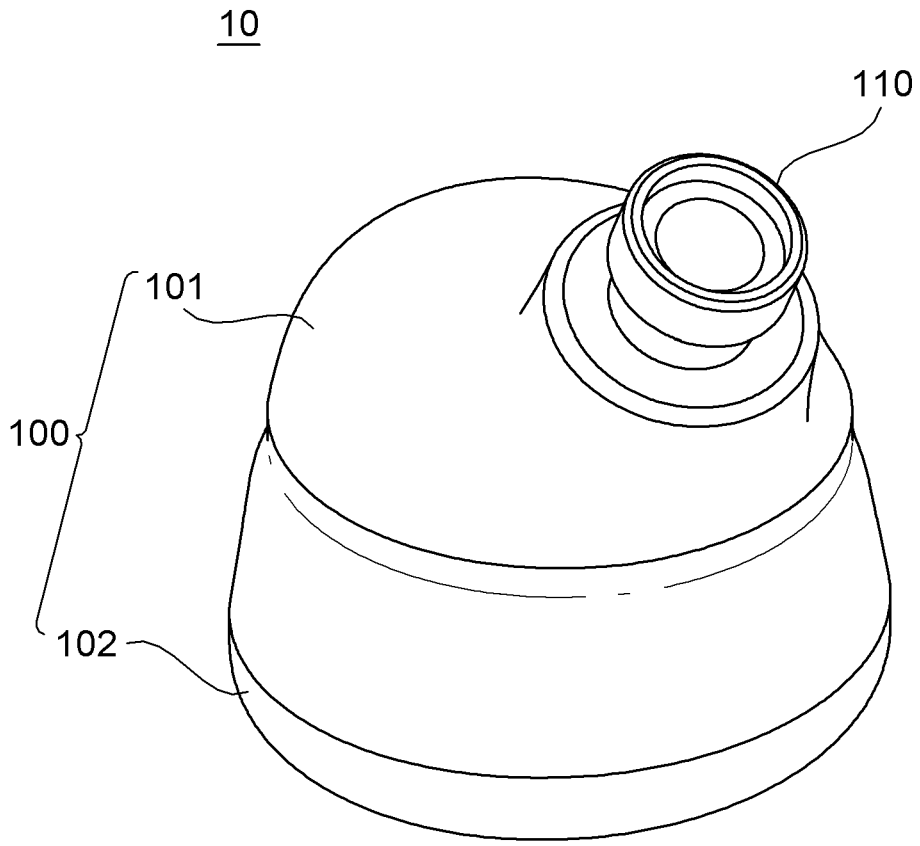

【FIG.2】
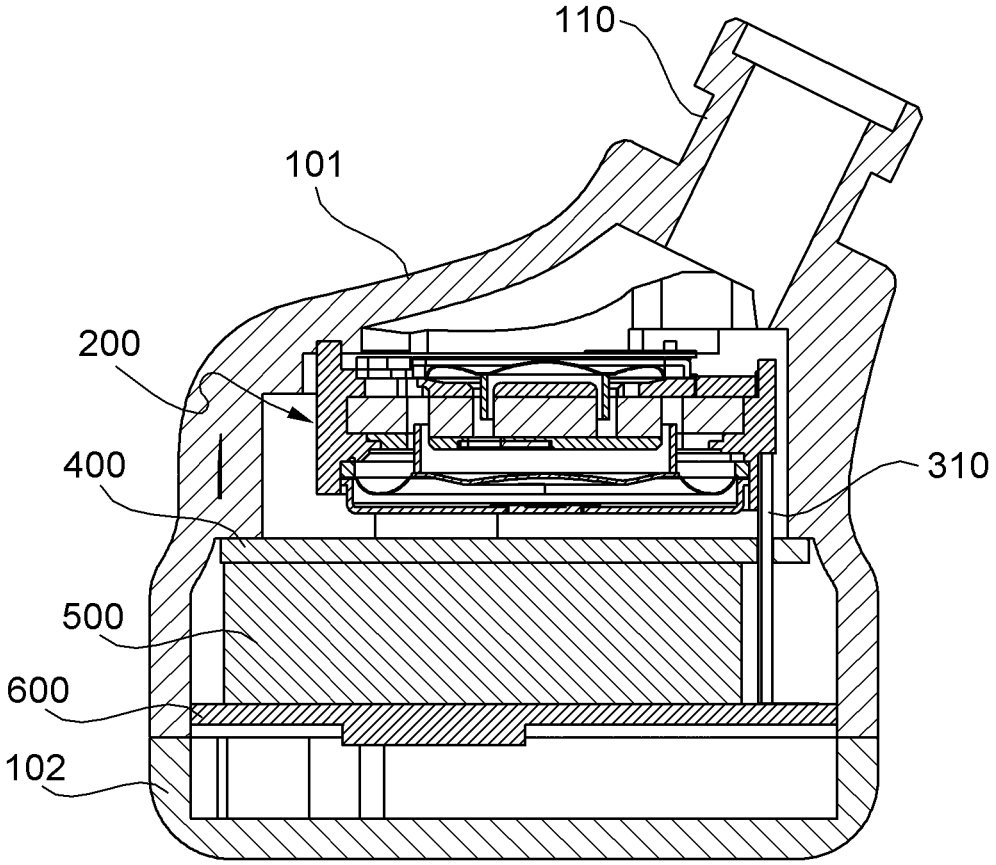

【FIG.3】
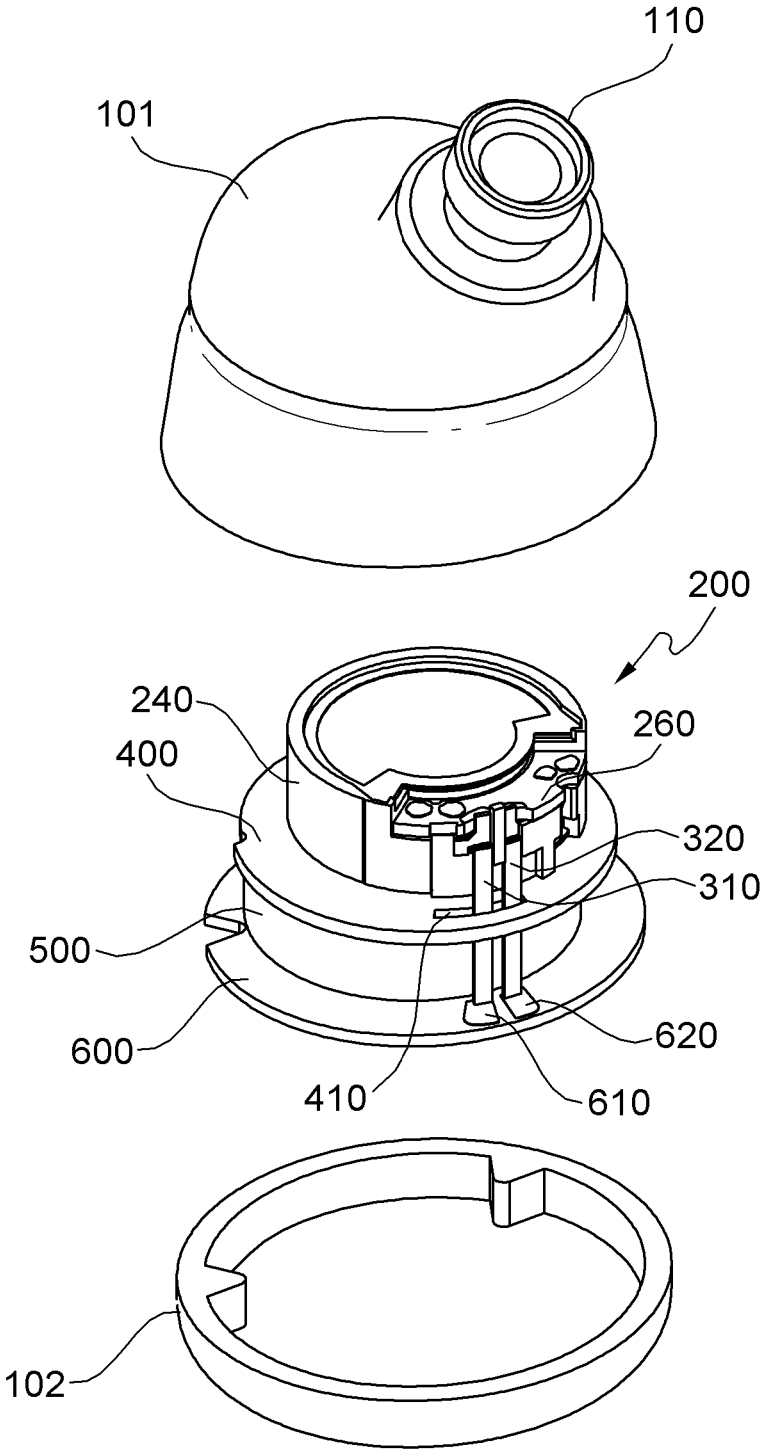

【FIG.4】
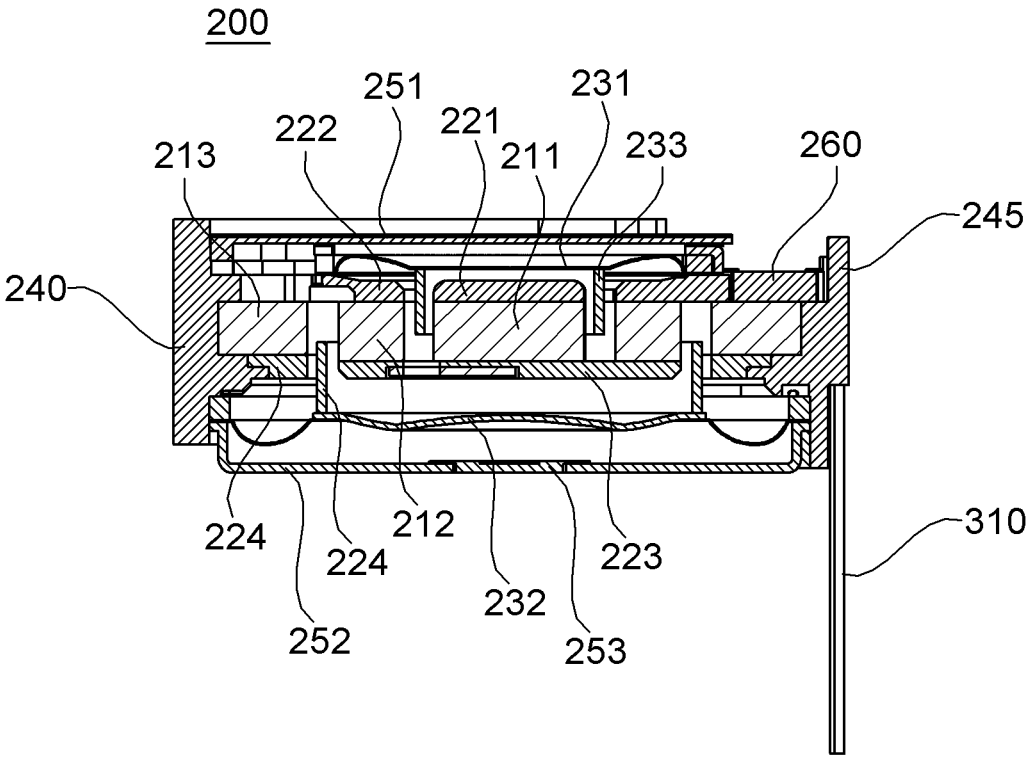

【FIG.5】
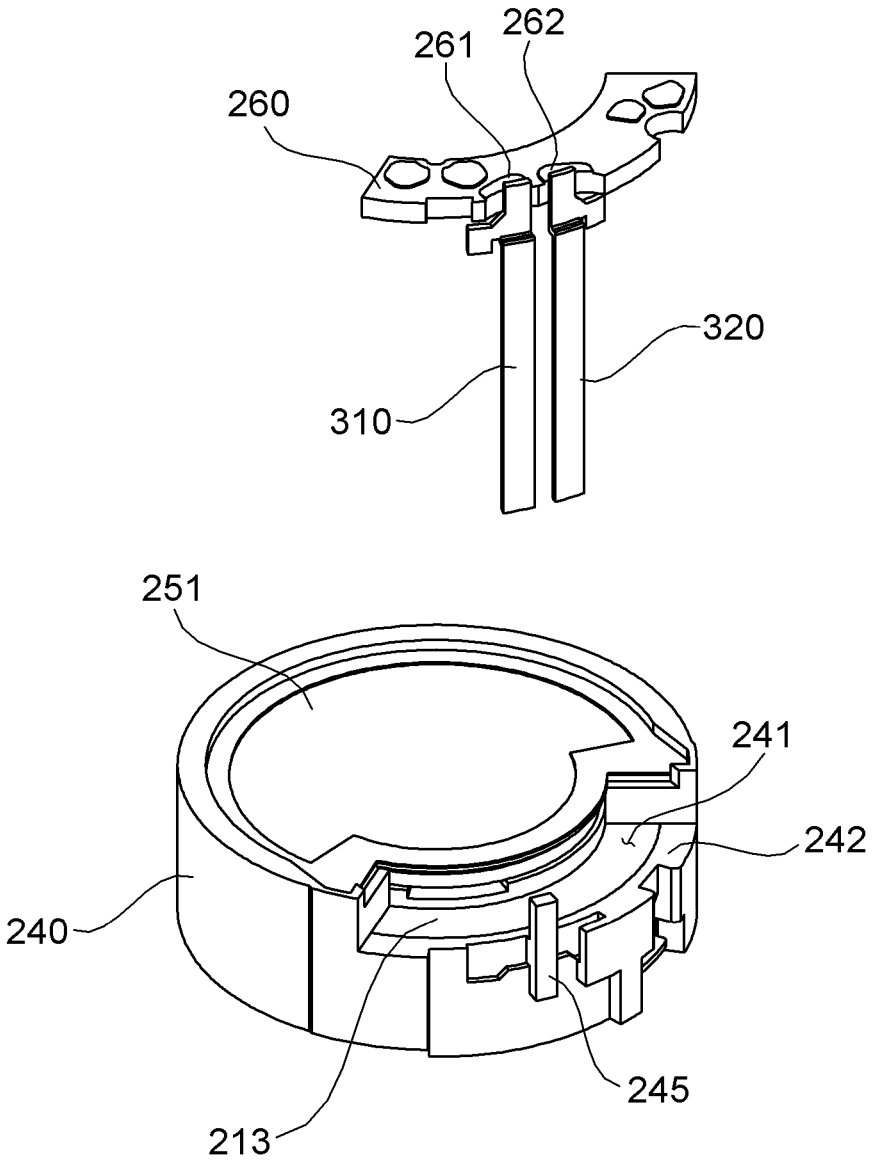

【FIG.6】
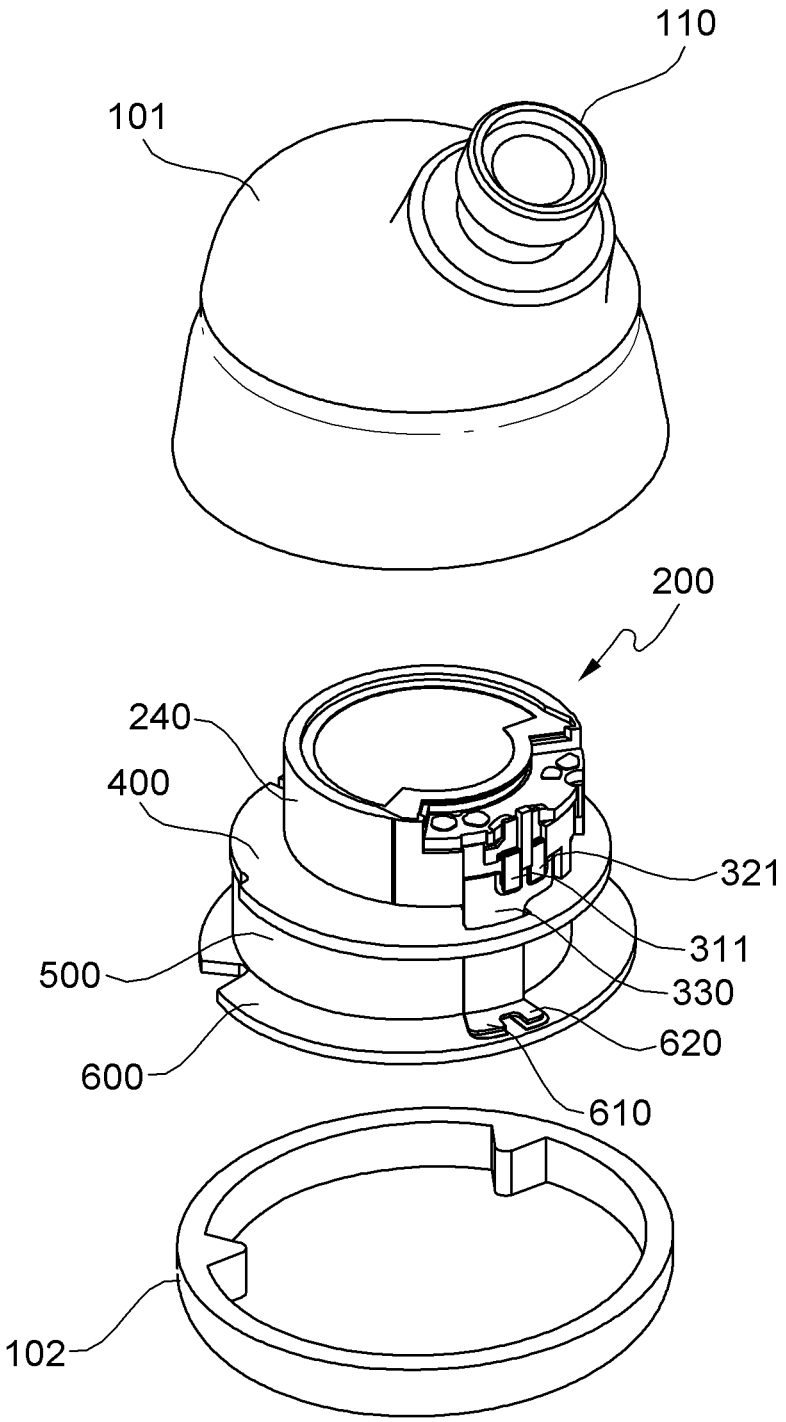

【FIG.7】
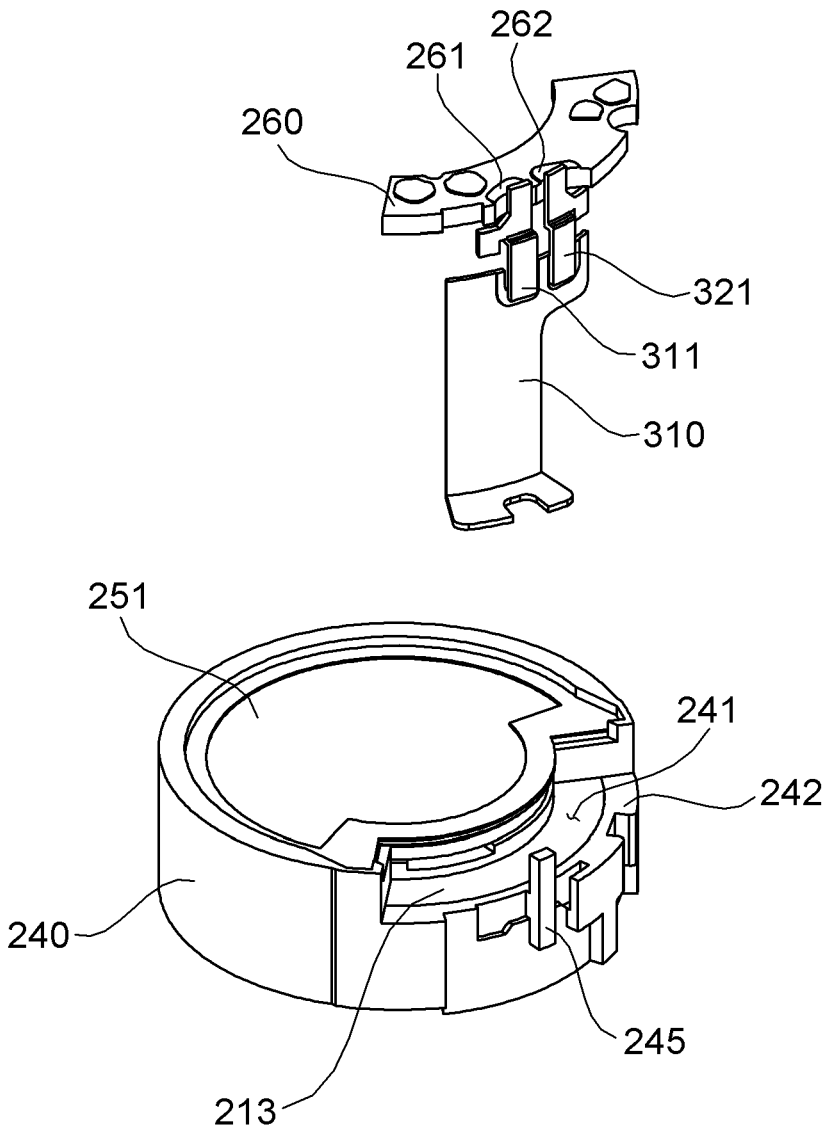

【FIG.8】
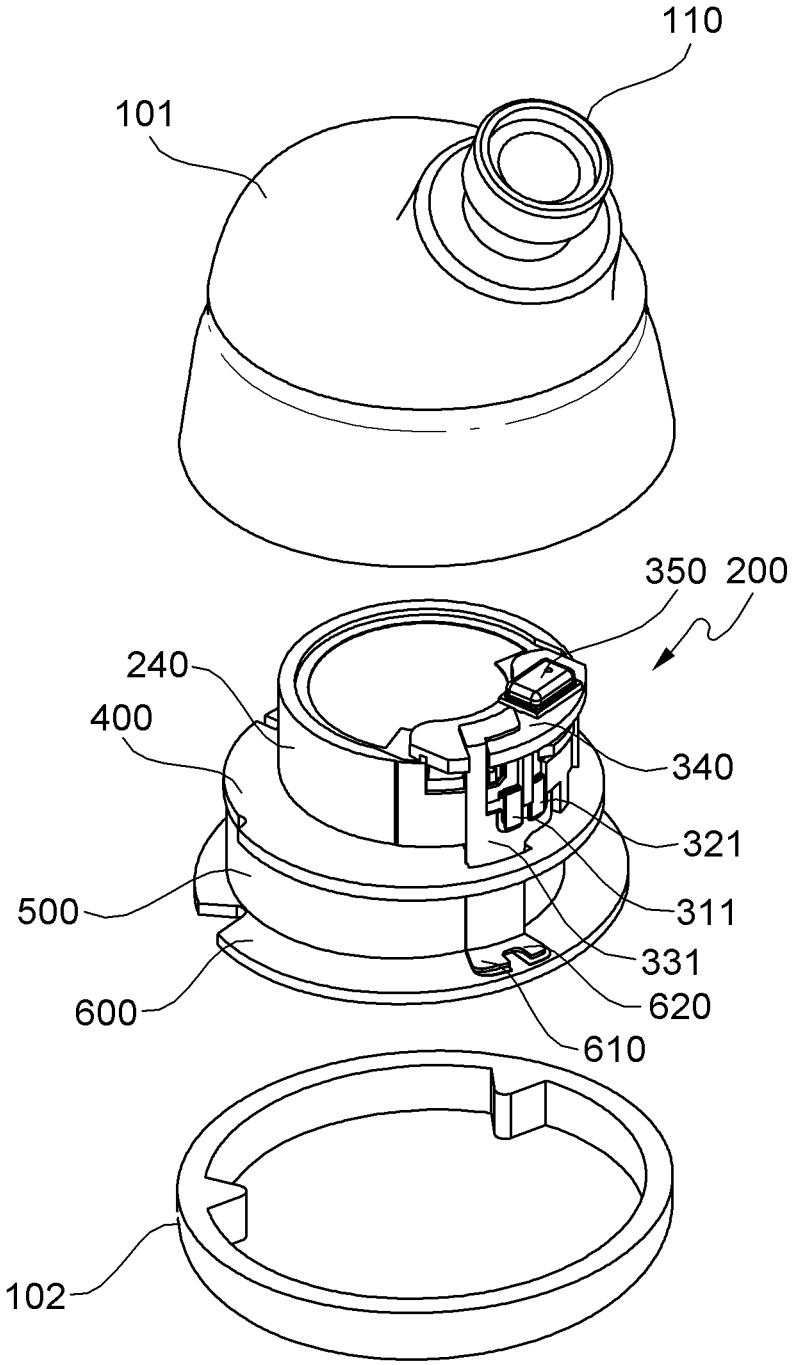

【FIG.9】
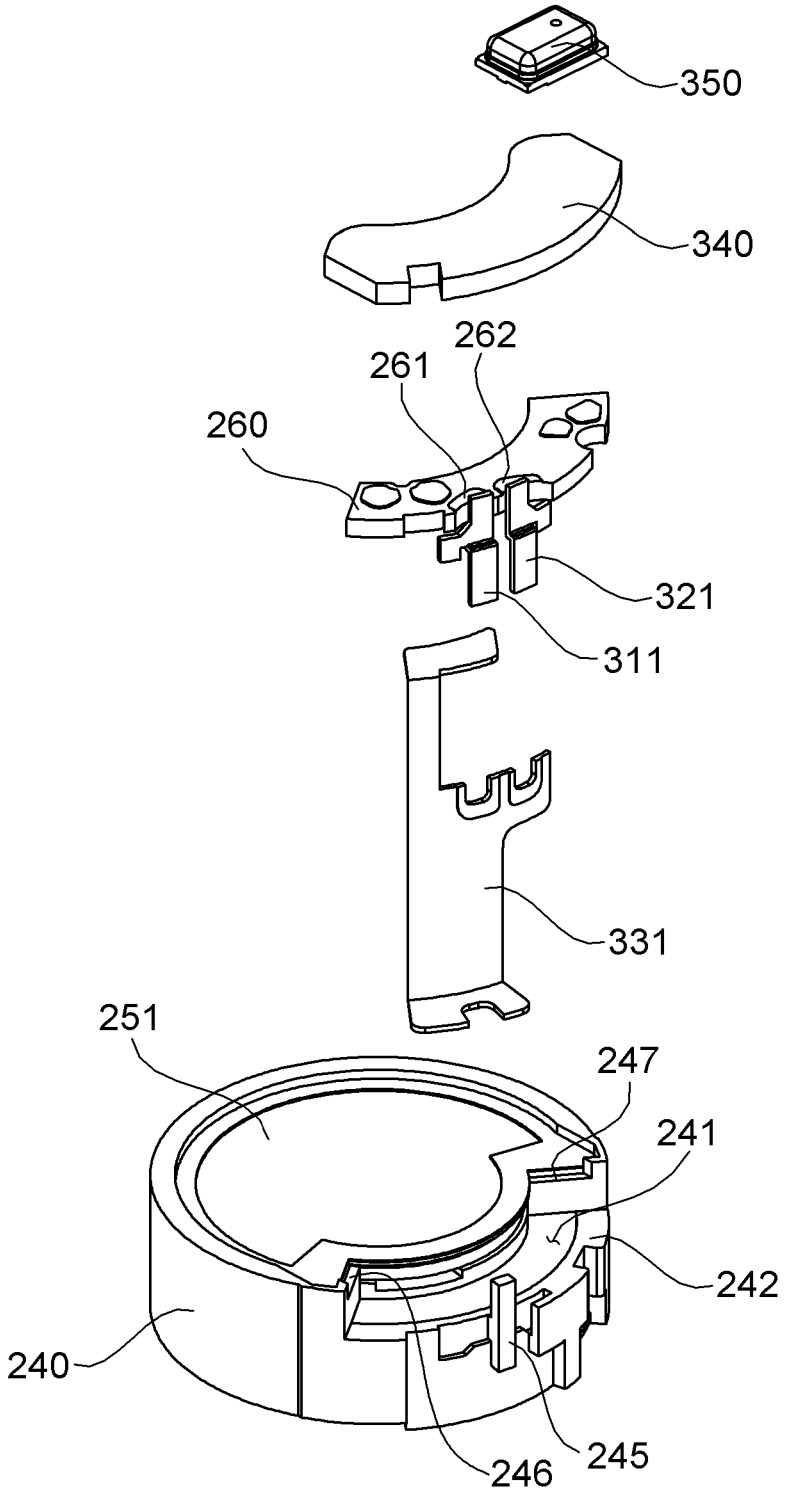

EARPHONE

CROSS-REFERENCE TO RELATED APPLICATION

This application claims priority to and the benefit of Korean Patent Application No. 2020-0031891, filed on Mar. 16, 2020, the disclosure of which is incorporated herein by reference in its entirety.

BACKGROUND

1. Field of the Invention

The present invention relates to an earphone, and more particularly, to an earphone in which a printed circuit board, a battery, or the like for an additional function is installed.

2. Discussion of Related Art

Generally, an earphone is an electronic device and/or additional device which includes a miniaturized speaker unit built therein and is put in his or her ear (for example, an external auditory meatus) and capable of directly releasing a sound generated at the speaker unit toward an inside of his or her ear so as to allow a user to hear the sound with low power. The user may comfortably listen to music and the like without regard to ambient conditions by using an earphone being coupled to an electronic device such as a mobile communication terminal, a portable multimedia player, a tablet personal computer (PC), and the like.

Recently, earphones having additional functions such as wireless earphones, adaptive noise cancellation (ANC) earphones, and the like have been generally used. In the case of such earphones, in addition to a speaker unit, a printed circuit board (PCB), a battery, or the like for implementing an additional function is additionally installed in an earphone, for example, below the speaker unit.

Meanwhile, a substrate, which receives an electrical signal corresponding to a sound signal, is provided in the speaker unit. Here, the substrate is generally disposed on a lower side of the speaker unit. Also, in some speaker units, an additional diaphragm is provided on a lower side of a speaker as well as an upper side thereof to improve a frequency band property.

When a PCB, a batter, or the like for an additional function is installed in an earphone, it causes a spatial inconvenience to dispose a substrate, which receives an electrical signal for a speaker unit, on a lower side of the speaker unit and may be an obstacle to miniaturization of the earphone. Also, when an additional diaphragm is provided below the speaker unit, it is more difficult to dispose the substrate, which receives the electrical signal for the speaker unit, on the lower side of the speaker unit.

SUMMARY OF THE INVENTION

The present invention is directed to providing an earphone improved in spatial efficiency and advantageous to miniaturization by disposing a substrate, which receives an electrical signal for a speaker unit, on an upper side of the speaker unit when a printed circuit board (PCB), a battery, or the like for an additional function is installed in the earphone or when an additional diaphragm is provided on a lower side of the speaker unit.

An aspect of the present invention is not limited to the above-stated aspect and other unstated aspects of the present invention will be understood by those skilled in the art from a following description.

According to an aspect of the present invention, there is provided an earphone including a housing, a speaker unit accommodated in the housing, and a printed circuit board (PCB) accommodated in the housing, disposed below the speaker unit, and configured to provide an electrical signal to the speaker unit. Here, the speaker unit includes a first diaphragm, a first voice coil fixed to the first diaphragm, at least one magnet disposed below the first diaphragm, a frame which accommodates the first diaphragm, the first voice coil, and the magnet, and a substrate which receives and transmits an electrical signal from the PCB to the first voice coil. The substrate is disposed on an upper side of the speaker unit. The earphone further includes a connection pin.

The frame may include a cut groove formed on one side in a circumferential direction to be recessed inward from a top and a side, and the substrate may be mounted on the cut groove.

A top surface of the substrate may be disposed not to protrude above a top end of the frame.

The frame may include a mounting surface formed outside the cut groove along the circumferential direction and on which a bottom surface of the substrate is mounted.

The frame may include a guide portion formed outside the cut groove and configured to restrict a position of the substrate not to allow the substrate to deviate from the frame.

The connection pin may be disposed outside a side surface of the frame so as to allow a top thereof to come into contact with a side surface of the substrate and vertically extend.

The connection pin may extend from the substrate to the PCB and electrically connect a terminal of the substrate to a terminal of the PCB.

The upper side of the connection pin may be connected to a terminal of the substrate, and the earphone may further include a flexible PCB (FPCB) which is connected to a bottom of the connection pin and electrically connects the connection pin to a terminal of the PCB.

The earphone may further include a microphone disposed above the substrate. Here, the FPCB may electrically connect the microphone to a microphone terminal of the PCB.

The earphone may further include a bracket disposed above the substrate. Here, the microphone may be mounted on the bracket.

The speaker unit may further include a second diaphragm disposed below the first diaphragm and a second voice coil fixed to the second diaphragm. Here, the at least one magnet may be disposed between the first diaphragm and the second diaphragm, and the substrate may transmit the electrical signal to the first voice coil and the second voice coil.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a perspective view of an earphone according to a first embodiment of the present invention;

FIG. 2 is a cross-sectional view of the earphone according to the first embodiment of the present invention;

FIG. 3 is an exploded view of the earphone according to the first embodiment of the present invention;

FIG. 4 is a cross-sectional view illustrating a speaker unit of the earphone according to the first embodiment of the present invention;

FIG. 5 is an exploded view illustrating the speaker unit of the earphone according to the first embodiment of the present invention;

FIG. 6 is an exploded view of an earphone according to a second embodiment of the present invention;

FIG. 7 is an exploded view illustrating a speaker unit of the earphone according to the second embodiment of the present invention;

FIG. 8 is an exploded view of an earphone according to a third embodiment of the present invention; and FIG. 9 is an exploded view illustrating a speaker unit of the earphone according to the third embodiment of the present invention.

DETAILED DESCRIPTION OF EXEMPLARY EMBODIMENTS

Hereinafter, exemplary embodiments of the present invention will be described in detail with reference to the drawings. Hereinafter, throughout the description and the attached drawings, substantially like elements will be referred to as like reference numerals and a repetitive description thereof will be omitted. Also, in a description of the embodiments of the present invention, a detailed description of well-known functions or components of the related art will be omitted when it is deemed to obscure understanding of the embodiments of the present invention.

FIGS. 1 to 5 are views of an earphone 10 according to a first embodiment of the present invention. FIG. 1 is a perspective view of the earphone 10 according to the first embodiment of the present invention, FIG. 2 is a cross-sectional view of the earphone 10 according to the first embodiment of the present invention, FIG. 3 is an exploded view of the earphone 10 according to the first embodiment of the present invention, FIG. 4 is a cross-sectional view of a speaker unit 200 of the earphone 10 according to the first embodiment of the present invention, and FIG. 5 is an exploded view illustrating the speaker unit 200 of the earphone 10 according to the first embodiment of the present invention.

The earphone 10 according to the first embodiment of the present invention may include the speaker unit 200, a division plate 400, a battery 500, a printed circuit board (PCB) 600, connection pins 310 and 320, and a housing 100 which accommodates the speaker unit 200, the division plate 400, the battery 500, the PCB 600, and the connection pins 310 and 320.

The housing 100 may be formed by coupling an upper housing 101 with an open bottom to a lower housing 102 with an open top. The upper housing 101 may include a nozzle 110 which releases a sound output from the speaker unit 200.

The speaker unit 200 receives and converts an electrical signal from the PCB 600 and generates a sound.

The division plate 400 is disposed below the speaker unit 200 and divides an internal space of the earphone 10 into a space in which the speaker unit 200 is disposed and a space in which the battery 500 and the PCB 600 is disposed. Depending on an embodiment, the division plate 400 may not be provided.

The battery 500 is disposed below the division plate 400 and supplies power to the PCB 600.

The PCB 600 is disposed below the battery 500, allows a variety of circuits including a communication module (for example, a Bluetooth module), an adaptive noise cancellation (ANC) module, and the like to be mounted thereon, and provides an electrical signal corresponding to a sound signal to the speaker unit 200. In the embodiment, the PCB 600 is disposed below the battery 500 but positions of the PCB 600 and the battery 500 may be switched.

The speaker unit 200 may include a first diaphragm 231, a second diaphragm 232, a first voice coil 233, a second voice coil 234, a first magnet 211, a second magnet 212, a third magnet 213, a first upper plate 221, a second upper plate 222, a first lower plate 223, a second lower plate 224, an upper mesh 251, a lower cover 252, a lower mesh 253, a frame 240, a substrate 260, and the like.

The first diaphragm 231 is disposed on an upper side of the speaker unit 200, and the first voice coil 233 is fixed to the first diaphragm 231. The second diaphragm 232 is disposed below the first diaphragm 231 in a direction opposite the first diaphragm 231, and the second voice coil 234 is fixed to the second diaphragm 232. A diameter of the second diaphragm 232 may be greater than that of the first diaphragm 231, and a diameter of the second voice coil 234 may be greater than that of the first voice coil 233. The first magnet 211, the second magnet 212, the third magnet 213, the first upper plate 221, the second upper plate 222, the first lower plate 223, and the second lower plate 224 may be disposed between the first diaphragm 231 and the second diaphragm 232.

The first magnet 211 and the first upper plate 221 have disc shapes having generally equal outer diameters, and the first upper plate 221 is fixed to a top surface of the first magnet 211. The first magnet 211 and the first upper plate 221 are disposed inside the first voice coil 233. The second magnet 212 and the second upper plate 222 have ring shapes having generally equal inner diameters, and the second upper plate 222 is fixed to a top surface of the second magnet 212. The second magnet 212 and the second upper plate 222 are disposed outside the first voice coil 233 to surround the first voice coil 233. The first lower plate 223 having a disc shape and an outer diameter generally equal to that of the second magnet 212 is fixed to bottom surfaces of the first magnet 211 and the second magnet 212. The first magnet 211, the second magnet 212, and the first lower plate 223 are disposed inside the second voice coil 234. The third magnet 213 and the second lower plate 224 have ring shapes having generally equal inner diameters, and the second lower plate 224 is fixed to a bottom surface of the third magnet 213. The third magnet 213 and the second lower plate 224 are disposed outside the second voice coil 234 to surround the second voice coil 234.

The upper mesh 251 is disposed above the first diaphragm 231. The lower cover 252 is disposed below the second diaphragm 232, and the lower mesh 253 is installed in a hole formed at a center of the lower cover 252. A sound generated at the first diaphragm 231 is released generally through the upper mesh 251, and a sound generated at the second diaphragm 232 is released generally through the lower mesh 253.

The frame 240 generally has a cylindrical shape with an open top and an open bottom and accommodates the first diaphragm 231, the second diaphragm 232, the first voice coil 233, the second voice coil 234, the first magnet 211, the second magnet 212, the third magnet 213, the first upper plate 221, the second upper plate 222, the first lower plate 223, the second lower plate 224, and the like. The upper mesh 251 is coupled to the frame 240 to cover a top of the frame 240, and the lower cover 22 is coupled to the frame 240 to cover a bottom of the frame 240.

The substrate 260 receives an electrical signal from the PCB 600 and transmits the electrical signal to the first voice coil 233 and the second voice coil 234 through, for example, a wire (not shown). The substrate 260 is disposed on the upper side the speaker unit 200. The frame 240 includes a cut groove 241 formed on one side in a circumferential direction and recessed inward from a top and a side such that the substrate 260 may be mounted in the cut groove 241. The frame 240 may include a mounting surface 242 formed outside the cut groove 241 along the circumferential direction and on which a bottom surface of the substrate 260 is mounted. A depth of the cut groove 241 from a top end of the frame 240 is formed to be greater than a thickness of the substrate 260 such that a top surface of the substrate 260 may be disposed not to protrude above the top end of the frame 240. Accordingly, it is possible to prevent an overall thickness of the speaker unit 200 from being increased by the thickness of the substrate 260.

The frame 240 may include a guide portion 245 formed outside the cut groove 241 and configured to restrict a position of the substrate 260 not to allow the substrate 260 to deviate outward from the frame 240 in a radial direction. The guide portion 245 may be formed to have a shape protruding more upward than the mounting surface 242 so as to support a side surface of the substrate 260.

The connection pins 310 and 320 are connected to the substrate 260 and transmit the electrical signal from the PCB 600 to the substrate 260. The connection pins 310 and 320 may extend from the substrate 260 to the PCB 600 so as to electrically connect the substrate 260 and the PCB 600 to each other. The connection pins 310 and 320 may be disposed outside a side surface of the frame 240 to allow upper sides to come into contact with the side surface of the substrate 260 and vertically extend to a top surface of the PCB 600. The division plate 400 may include a hole 410 to allow the connection pins 310 and 320 to pass therethrough.

The PCB 600 may include a first terminal 610 which outputs a positive electrical signal and a second terminal 620 which outputs a negative electrical signal. The substrate 260 may include a third terminal 261 which receives a positive electrical signal and a fourth terminal 262 which receives a negative electrical signal. The third terminal 261 and the fourth terminal 262 may be formed throughout a top surface and the side surface of the substrate 260. A first connection pin 310 may electrically connect the first terminal 610 of the PCB 600 to the third terminal 261 of the substrate 260. A second connection pin 320 may electrically connect the second terminal 620 of the PCB 600 to the fourth terminal 262 of the substrate 260. An upper side of the first connection pin 310 may come into contact with a side surface of the third terminal 261 and a bottom end thereof may come into contact with the first terminal 610. An upper side of the second connection pin 320 may come into contact with a side surface of the fourth terminal 262 and a bottom end thereof may come into contact with the second terminal 620.

FIGS. 6 and 7 are views of an earphone according to a second embodiment of the present invention. FIG. 6 is an exploded view of the earphone according to the second embodiment of the present invention, and FIG. 7 is an exploded view illustrating a speaker unit of the earphone according to the second embodiment of the present invention. Since the second embodiment is substantially equal to the first embodiment except the connection pins 310 and 320, differences from the first embodiment will be mainly described below.

The earphone according to the second embodiment of the present invention includes, instead of the connection pins 310 and 320, connection pins 311 and 321 and a flexible PCB (FPCB) 330.

The connection pins 310 and 320 of the first embodiment pass through the hole 410 of the division plate 400 and extend to the PCB 600 to be directly connected to the terminals 610 and 620 of the PCB 600. On the other hand, the connection pins 311 and 321 of the second embodiment are formed to be shorter than the connection pins 310 and 320 of the first embodiment such that bottom ends are located above the division plate 400 and the FPCB 330 is connected to a lower side thereof. Also, the FPCB 330 passes through the hole 410 of the division plate 400 and extends to the PCB 600 to be connected to the terminals 610 and 620 of the PCB 600. That is, the terminals 261 and 262 of the substrate 260 and the terminals 610 and 620 of the PCB 600 are electrically connected to each other through the connection pins 311 and 321 and the FPCB 330.

The FPCB 330 is flexible such that a bottom thereof may be bent and easily come into contact with the terminals 610 and 620 on top of the PCB 600. Although not shown in the drawings, the FPCB 330 may include a conductive pattern, which electrically connect the first terminal 610 to the first connection pin 310, and a conductive pattern which electrically connects the second terminal to the second connection pin 320.

FIGS. 8 and 9 are views of an earphone according to a third embodiment of the present invention. FIG. 8 is an exploded view of the earphone according to the third embodiment of the present invention, and FIG. 9 is an exploded view illustrating a speaker unit of the earphone according to the third embodiment of the present invention. Since the third embodiment is substantially equal to the second embodiment except an addition of a bracket 340 and a microphone 350 and modification of the FPCB 330, only differences from the second embodiment will be mainly described below for convenience.

The microphone 350 is configured to perform an ANC function and may be disposed in front of the speaker unit 200. To this end, the bracket 340 may be disposed above the substrate 260, and the microphone 350 may be mounted on the bracket 340. To allow the top surface of the substrate 260 to be spaced apart from the bracket 340, the frame 240 may include mounting ends 246 and 274 on both sides of the cut groove 241 to be higher than the top surface of the substrate 260 and on which an edge of a bottom surface of the bracket 340 is mounted.

The PCB 600 may include an ANC module and a microphone terminal to which a signal is input from the microphone 350 to perform ANC treatment. An FPCB 331 may extend from the PCB 600 to the microphone 350 and electrically connect the PCB 600 to the microphone 350. Although not shown in the drawings, the FPCB 331 may include a conductive pattern which electrically connects the microphone terminal of the PCB 600 to the microphone 350.

According to the present invention, there is provided an effect of improving spatial efficiency and providing an advantage in miniaturization of an earphone by disposing a substrate, which receives an electrical signal for a speaker unit, on an upper side of the speaker unit when a PCB, a battery, or the like for an additional function is installed in the earphone or when an additional diaphragm is provided on a lower side of the speaker unit.

Effects of the present invention are not limited to the above-stated effect and other unstated effects of the present invention will be understood by those skilled in the art from the above disclosure.

The exemplary embodiments of the present invention have been described above. It should be understood by one of ordinary skill in the art that the present invention may be implemented as a modified form without departing from the essential features of the present invention. Therefore, the disclosed embodiments should be considered not in a limitative view but in a descriptive view. The scope of the present invention will be shown in the utility model registration claims not in the above description, and all differences within an equivalent range thereof should be construed as being included in the present invention.

What is claimed is:

1. An earphone comprising:
a housing;
a speaker unit accommodated in the housing;
a connection pin; and
a printed circuit board (PCB) accommodated in the housing, disposed below the speaker unit, and configured to provide an electrical signal to the speaker unit,
wherein the speaker unit comprises:
a first diaphragm;
a first voice coil fixed to the first diaphragm;
at least one magnet disposed below the first diaphragm;
a frame which accommodates the first diaphragm, the first voice coil, and the magnet; and
a substrate which receives and transmits an electrical signal from the PCB to the first voice coil, and
wherein the substrate is disposed on an upper side of the speaker unit,
wherein the frame comprises a cut groove formed on one side in a circumferential direction to be recessed inward from a top and a side, and
wherein the substrate is mounted on the cut groove.

2. The earphone of claim 1, wherein a top surface of the substrate is disposed not to protrude above a top end of the frame.

3. The earphone of claim 1, wherein the frame comprises a mounting surface formed outside the cut groove along the circumferential direction and on which a bottom surface of the substrate is mounted.

4. The earphone of claim 1, wherein the frame comprises a guide portion formed outside the cut groove and configured to restrict a position of the substrate not to allow the substrate to deviate from the frame.

5. The earphone of claim 1, wherein the connection pin is disposed outside a side surface of the frame so as to allow an upper side thereof to come into contact with a side surface of the substrate and vertically extend.

6. An earphone comprising:
a housing;
a speaker unit accommodated in the housing;
a connection pin; and
a printed circuit board (PCB) accommodated in the housing, disposed below the speaker unit, and configured to provide an electrical signal to the speaker unit,
wherein the speaker unit comprises:
a first diaphragm;
a first voice coil fixed to the first diaphragm;
at least one magnet disposed below the first diaphragm;
a frame which accommodates the first diaphragm, the first voice coil, and the magnet; and
a substrate which receives and transmits an electrical signal from the PCB to the first voice coil,
wherein the substrate is disposed on an upper side of the speaker unit, and
wherein the connection pin extends from the substrate to the PCB and electrically connects a terminal of the substrate to a terminal of the PCB.

7. An earphone comprising:
a housing;
a speaker unit accommodated in the housing;
a connection pin; and
a printed circuit board (PCB) accommodated in the housing, disposed below the speaker unit, and configured to provide an electrical signal to the speaker unit,
wherein the speaker unit comprises:
a first diaphragm;
a first voice coil fixed to the first diaphragm;
at least one magnet disposed below the first diaphragm;
a frame which accommodates the first diaphragm, the first voice coil, and the magnet; and
a substrate which receives and transmits an electrical signal from the PCB to the first voice coil,
wherein the substrate is disposed on an upper side of the speaker unit, and
wherein an upper side of the connection pin is connected to a terminal of the substrate, the earphone further comprising a flexible PCB (FPCB) which is connected to a bottom of the connection pin and electrically connects the connection pin to a terminal of the PCB.

8. The earphone of claim 7, further comprising a microphone disposed above the substrate,
wherein the FPCB electrically connects the microphone to a microphone terminal of the PCB.

9. The earphone of claim 8, further comprising a bracket disposed above the substrate,
wherein the microphone is mounted on the bracket.

10. An earphone comprising:
a housing;
a speaker unit accommodated in the housing;
a connection pin; and
a printed circuit board (PCB) accommodated in the housing, disposed below the speaker unit, and configured to provide an electrical signal to the speaker unit,
wherein the speaker unit comprises:
a first diaphragm;
a first voice coil fixed to the first diaphragm;
at least one magnet disposed below the first diaphragm;
a frame which accommodates the first diaphragm, the first voice coil, and the magnet; and
a substrate which receives and transmits an electrical signal from the PCB to the first voice coil,
wherein the substrate is disposed on an upper side of the speaker unit,
wherein the speaker unit further comprises:
a second diaphragm disposed below the first diaphragm; and
a second voice coil fixed to the second diaphragm,
wherein the at least one magnet is disposed between the first diaphragm and the second diaphragm, and
wherein the substrate transmits the electrical signal to the first voice coil and the second voice coil.

* * * * *